US007156205B2

(12) United States Patent
Wilson et al.

(10) Patent No.: US 7,156,205 B2
(45) Date of Patent: Jan. 2, 2007

(54) STEP LADDER SAFETY DEVICE

(75) Inventors: Al Lynn Wilson, Grand Blanc, MI (US); Herbert Arthur Moore, Lapeer, MI (US); Norman E Morey, North Branch, MI (US)

(73) Assignee: Custom Products Enterprises, Inc., Grand Blanc, MI (US)

( * ) Notice: Subject to any disclaimer, the term of this patent is extended or adjusted under 35 U.S.C. 154(b) by 81 days.

(21) Appl. No.: 10/756,519

(22) Filed: Jan. 14, 2004

(65) Prior Publication Data

US 2005/0150723 A1 Jul. 14, 2005

(51) Int. Cl.
*E06C 5/32* (2006.01)

(52) U.S. Cl. ..... 182/129; 220/830; 206/373

(58) Field of Classification Search ..... 182/129, 182/230; 248/210, 211, 238; 220/570, 573, 220/578, 830, 845, 848; D25/68; 206/372, 206/373, 541, 549, 544
See application file for complete search history.

(56) References Cited

U.S. PATENT DOCUMENTS 2,483,304 A * 9/1949 Vogel ..... 220/324
2,506,789 A * 5/1950 Hyde ..... 220/832
3,355,088 A * 11/1967 Young ..... 220/845
3,472,339 A * 10/1969 Crisogono et al. ..... 182/129
4,310,134 A * 1/1982 Schopp et al. ..... 248/210
5,505,302 A * 4/1996 Ferley ..... 206/373
5,603,405 A * 2/1997 Smith ..... 206/373
5,913,380 A * 6/1999 Gugel et al. ..... 182/129
5,971,102 A * 10/1999 Brown ..... 182/129
6,435,389 B1 * 8/2002 Sucher ..... 206/373
6,443,260 B1 * 9/2002 Katz et al. ..... 182/129
6,564,941 B1 * 5/2003 Hedges ..... 206/373
6,766,881 B1 * 7/2004 Carty ..... 182/129

* cited by examiner

*Primary Examiner*—Hugh B. Thompson, II
(74) *Attorney, Agent, or Firm*—Flint Patent Service; Jack E. Tubbs

(57) ABSTRACT

A novel safety device for step ladders. This safety device is fabricated and positioned so as to deter, dissuade and deny the ladder user access to the unsupported top step of a step ladder while allowing the user to an aloft tool organizer for pre-loading job materials thereby eliminating the need to repeatedly climb up and down the ladder carrying materials. More people are killed doing construction work every year than in any other occupation and falls are the biggest killer of employees in the construction industry, many of these falls involve the improper use of ladders. Falls are the leading cause of death in and around the home, according to the National Safety Council, there are thousands of people die from falls around the home each year and many suffer disabling injuries many of these also involve ladders. At work or at home, these accidents invariably occur because the victims violate the basic rules of ladder safety.

6 Claims, 2 Drawing Sheets

STEP LADDER SAFETY DEVICE

CROSS REFERENCES TO RELATED APPLICATIONS

None

Statement as to the right to inventions made under Federally sponsored research and development Not Applicable

BACKGROUND OF THE INVENTION

The background of the invention is generally that of a safety device and more specifically to a novel step ladder safety peripheral, fabricated and positioned so as to deter, dissuade and deny access to the user the ability to stand on the very top unsupported step of a step ladder and a user friendly tool—material organizer mounted aloft, securable to the top step (cap) of the ladder, diminishing the number of multiple ascents and descents . According to the National Safety Council there are thousands of people die from falls in and around the home each year and many of these are caused by the improper use of a step ladder. In fact there are more than 30,000 people are injured each year by falls involving ladders.

Manufactures of step ladders, under the direction of OSHA, use warning labels and written instructions on the safe use of ladders. These warnings and instructions always warn the user to never stand on the very top step (cap) of a step ladder. The superficial use of warning labels and instructions, by prior art, has proved to be inadequate and ineffective.

It is an observation of this inventor that it is indeed difficult for manufactures of ladders to completely ensure public safety using this passive approach of written warnings because people seem to have a tendency to ignore or disregard them. It will be appreciated by those skilled in the art that to more readily ensure step ladder safety this safety device, properly configured and positioned, will actively deny user access to the top step (cap) will be more effective than written warnings.

It is another observation of this inventor that people, due to time constraints, workplace pressures or convenience do have the tendency to ignore written warnings and that these same written warnings are diminished to serving more to protect the liability of the manufactures than to public safety. It is a further observation of this inventor that this safety device provides the user an aloft tool—materials organizer that can be pre-loaded thereby avoiding unnecessary multiple step ladder ascents and descents carrying materials. It will be further appreciated by those skilled in the art that this safety device by deterring, dissuading and denying user foot access to the top step (cap) will provide enhanced step ladder safety.

SUMMARY OF THE INVENTION

The present invention is a steep pitched profile peripheral structure that when secured to the top step (cap) of a step ladder deters, dissuades and prohibits the user from standing on the unsupported top step (cap) or bucket shelf of the ladder. The presence of the invention visually stimulates the senses of the user, consciously and to the subconscious, to the fact that there is no room to stand on the top step thereby its presence removes the temptation to do so and greatly enhances the overall effectiveness of the manufactures warning labels and safety instructions. This ladder safety device at the same time allows the user an aloft tool—material organizer for preloading the ladder with the necessary materials diminishing the number of user ladder ascents and descents. As the number of times the user must go up and down the ladder decreases the sphere of ladder safety is enhanced.

It is an object of the invention to provide the user a device that fortifies the value of manufactures warning labels and safety instructions for step ladders by denying the the user foot access to standing on the very top step (cap).

It is another object of the invention to provide the owner a device that stops others users from standing on the top step (cap) when the owner isn't present.

It is another object of the invention to provide the user a device that visually deters and dissuades standing on the top step (cap).

It is a further object of the invention to provide the user a device which includes a strap that is adjustable to fit different sizes and shapes of steps.

It is a further object of the invention to provide a device that can be preloaded with tool and materials for the job thereby reducing the number of user ascents and descents on the ladder.

It is another object of the invention to provide the user a convenient spring return safety pitched shaped top for the receptacle for tools, paint and other job materials.

It is another object of the invention to provide the user a device that frees up both hands for working. Having both hands free makes for a safer work environment.

It is another object of the invention to provide the user a device that frees him from wearing a cumbersome and heavy tool pouch on his hip that sometimes snags and catchs on the rungs of the ladder when climbing.

It is another object of the invention to provide the user a device that is removable for convenient ladder storage.

Further objects are implicit in the detailed descriptions which follows hereinafter (which is to be considered as exemplary of, but not specifically limiting, the present invention) and said objects will be apparent to persons skilled in the art after a carefull study of the detailed descriptions which follows.

For the purpose of clarifying the nature of the present invention, one exemplary embodiment of the invention is illustrated in the hereinbelow-described figures of the accompanying drawing and is described in detail hereinafter. It is to be taken as representative of the multiple embodiments of the invention which lie within the scope of the invention.

DESCRIPTION OF THE PREFERRED EMBODIMENTS

Figure 1:
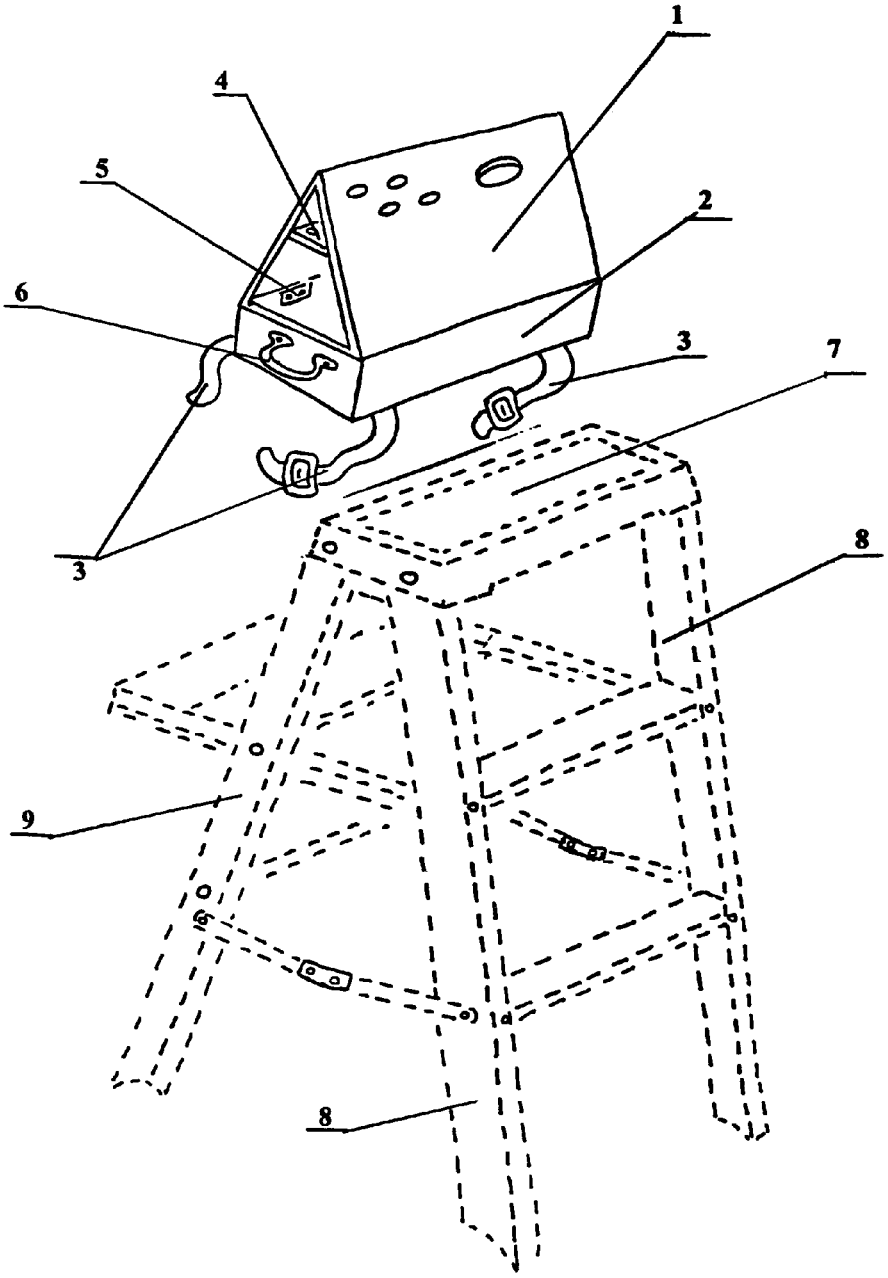
FIG. 1 is a perspective view showing one exemplary embodiment of one representative form of the invention.
Figure 2:
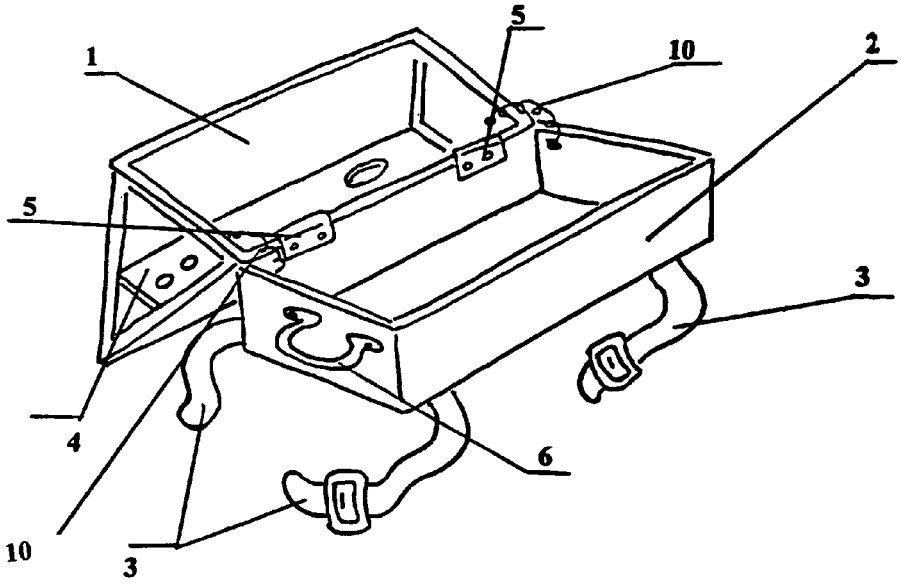
FIG. 2 is a perspective view showing one exemplary embodiment of one representative form of the invention.
Figure 3:
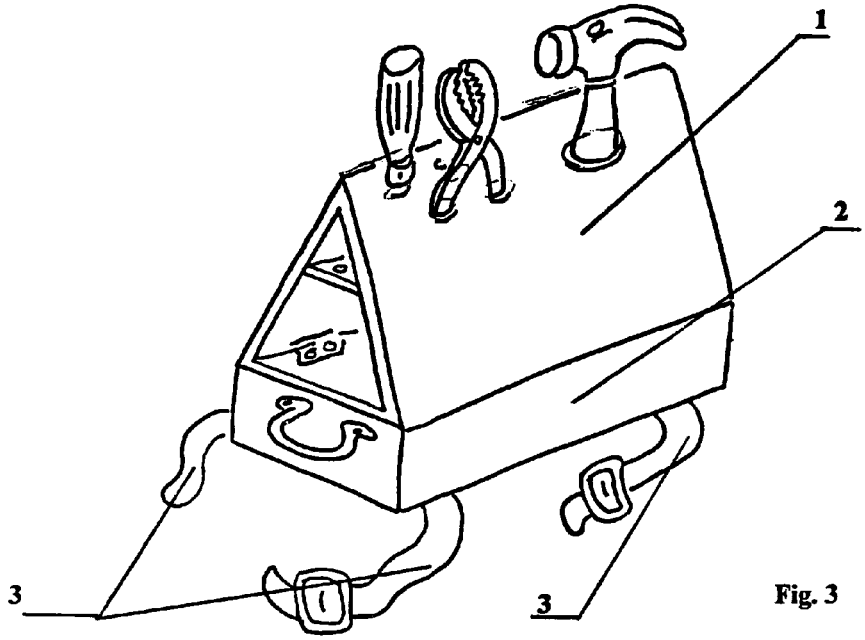
FIG. 3 is a perspective view showing one exemplary embodiment of one representative form of the invention.

Referring to FIG. 1. A step ladder safety device having an article receiving storage area and a hinged steep pitched top 1 for use in association with a step ladder having a first pair of front legs 8, a second pair of supporting legs 9 and a top step (cap) 7 with an upper surface. The step ladder safety storage device bottom 2 is secured to top step (cap) 7 with adjustable straps 3 to accommodate different shaped steps however other means of securing may also be used. Hinge 5, having two ends, the first end is secured to bottom receptacle 2 with screws, however other means of securing may also be used. The second end of hinge 5 is secured to steep pitch top 1 with screws however other means of securing may also be used. Hinge 5, as shown in FIG. 2, in the open position allows user access to the article receiving bottom receptacle 2. Springs 10, in the closed position, again returns top 1 to it's closed safe position, not allowing the user the ability to stand on the top step (cap) 7. Springs 10, having two ends, the first end is secured to bottom receptacle 2 with screws however other means of securing may also be used. The second end of spring 10 is secured to top 1 with screws however other means of securing may also be used. Tool holder 6 is attached to bottom receptacle 2 with screws however other means of securing may also be used. Bottom receptacle 2 is a molded part that is fabricated in one continuous flowing motion however other means of fabrication may also be used. Steep pitch top 1 is a molded part fabricated in one continuous flowing motion and has molded holes to house tools as shown in FIG. 3, however other means of fabrication may also be used. Tool aligner 4 provides a lower second hole to help align and hold the tools, tool aligner 4 is secured to steep pitched top 1 with screws however other means of securing may also be used.

What is claimed is:

1. A safety device for a step ladder having a top step, comprising:

a bottom base receptacle including a front wall, a rear wall, two side walls and a bottom, wherein the front wall, the rear wall, the two side walls and the bottom define an article-receiving storage area;

a pitched top having a steep-pitched profile, wherein the steep-pitched profile is substantially triangular along at least a portion of a longitudinal axis of the pitched top, the pitched top further having a rear side located proximately with respect to the rear wall;

an adjustable strap attached to the bottom base receptacle;

a hinge having first and second hinge ends, wherein the first hinge end is secured to the bottom base receptacle, further wherein the second hinge end is secured to the pitched top; and a spring having first and second spring ends, wherein the first spring end is secured to the bottom base receptacle, further wherein the second spring end is secured to the pitched top.

2. The safety device of claim 1:

further wherein the spring exerts a force on the pitched top which only biases the pitched top towards a closed position with respect to the bottom base receptacle.

3. A safety device for a step ladder having a top step, comprising:

a bottom base receptacle including a front wall, a rear wall, two side walls and a bottom, wherein the front wall, the rear wall, the two side walls and the bottom define an article-receiving storage area;

a pitched top having a steep-pitched profile, wherein the steep-pitched profile is substantially triangular along at least a portion of a longitudinal axis of the pitched top, the pitched top further having a rear side located proximately with respect to the rear wall, the pitched top further having a first plurality of holes molded therein;

an interior wall disposed within the pitched top and secured thereto, wherein the interior wall is substantially parallel with the bottom when the pitched top is in a closed position with respect to the bottom base receptacle, wherein the interior wall has a second plurality of holes molded therein, further wherein the first and second pluralities of holes cooperate to receive a tool; and an adjustable strap attached to the bottom base receptacle.

4. In combination, a step ladder and a safety device for the step ladder, the step ladder having a top step, the safe device having:

a bottom base receptacle including a front wall, a rear wall, two side walls and a bottom, wherein the front wall, the rear wall, the two side walls and the bottom define an article-receiving storage area;

a pitched top having a steep-pitched profile, wherein the steep-pitched profile is substantially triangular along at least a portion of a longitudinal axis of the pitched top, the pitched top further having a rear side located proximately with respect to the rear wall;

an adjustable strap attached to the bottom base receptacle, wherein the bottom base receptacle is secured to the top step with the adjustable strap;

a hinge having first and second hinge ends, wherein the first hinge end is secured to the bottom base receptacle, further wherein the second hinge end is secured to the pitched top; and a spring having first and second spring ends, wherein the first spring end is secured to the bottom base receptacle, further wherein the second spring end is secured to the pitched top.

5. The combination of claim 4:

further wherein the spring exerts a force on the pitched top which only biases the pitched top towards a closed position with respect to the bottom base receptacle.

6. In combination, a step ladder and a safety device for the step ladder, the step ladder having a top step, the safety device having:

a bottom base receptacle including a front wall, a rear wall, two side walls and a bottom, wherein the front wall, the rear wall, the two side walls and the bottom define an article-receiving storage area;

a pitched top having a steep-pitched profile, wherein the steep-pitched profile is substantially triangular along at least a portion of a longitudinal axis of the pitched top, the pitched top further having a rear side located proximately with respect to the rear wall, the pitched top further having a first plurality of holes molded therein;

an interior wall disposed within the pitched top and secured thereto, wherein the interior wall is substantially parallel with the bottom when the pitched top is in a closed position with respect to the bottom base receptacle, wherein the interior wall has a second plurality of holes molded therein, further wherein the first and second pluralities of holes cooperate to receive a tool; and an adjustable strap attached to the bottom base receptacle, wherein the bottom base receptacle is secured to the top step with the adjustable strap.

* * * * *